US007063315B2

(12) United States Patent
Lyu et al.

(10) Patent No.: US 7,063,315 B2
(45) Date of Patent: Jun. 20, 2006

(54) PICKUP ERROR-SENSING APPARATUS OF IMAGE FORMING APPARATUS AND METHOD THEREFOR

(75) Inventors: Se-hyun Lyu, Seoul (KR); Jin-soo Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/724,723

(22) Filed: Dec. 2, 2003

(65) Prior Publication Data

US 2004/0195757 A1 Oct. 7, 2004

(30) Foreign Application Priority Data

Dec. 9, 2002 (KR) ..... 10-2002-0077849

(51) Int. Cl.
*B65H 1/18* (2006.01)

(52) U.S. Cl. ..... 271/38; 271/110; 271/258.01

(58) Field of Classification Search ..... 271/38, 271/110, 119, 126, 127, 147, 258.01, 258.04
See application file for complete search history.

(56) References Cited

U.S. PATENT DOCUMENTS 4,888,617 A * 12/1989 Okuzawa ..... 355/400
5,204,726 A * 4/1993 Choi ..... 399/21
5,700,003 A * 12/1997 Sung ..... 271/110
5,897,112 A * 4/1999 Kwag ..... 271/38
2004/0041329 A1* 3/2004 Hiraoka ..... 271/110
2004/0195757 A1* 10/2004 Lyu et al. ..... 271/110

* cited by examiner

*Primary Examiner*—David H. Bollinger
(74) *Attorney, Agent, or Firm*—Staas & Halsey LLP

(57) ABSTRACT

A pickup error-sensing apparatus of an image forming apparatus and method therefor. The pickup error-sensing apparatus includes a sensing actuator rotatably disposed on a frame with respect to a paper cassette, displaceable when sheets of paper are loaded in the cassette, a paper sensor unit outputting a paper loading and unloading signals according to the displacement of the sensing actuator, a sensing actuator-operating unit operating the sensing actuator to allow the paper sensor unit to output the paper unloading signal when a pickup roller carries out a pickup movement, and a control unit determining whether the paper unloading signal is output when the pickup roller carries out the pickup movement, and determining occurrence of a pickup error to stop the image forming apparatus when the paper unloading signal is not output. The apparatus and method sense the pickup error generated from inadequate movement of the pick-up roller without installing a separate paper sensor.

13 Claims, 8 Drawing Sheets

PICKUP ERROR-SENSING APPARATUS OF IMAGE FORMING APPARATUS AND METHOD THEREFOR

CROSS-REFERENCE TO RELATED APPLICATION

This application claims the benefit of Korean Patent Application No. 2002-77849, filed on Dec. 9, 2002, in the Korean Intellectual Property Office, the disclosure of which is incorporated herein by reference.

BACKGROUND OF THE INVENTION

1. Field of the Invention

The present invention relates to an image forming apparatus, including a printer, a facsimile machine or a multi-function machine, and more particularly, to a pickup error-sensing apparatus of an image forming apparatus, and method therefor, capable of sensing a pickup error, generated as a result of inadequate movement of a pick-up roller, using a paper sensor installed at a paper tray or cassette 2. Description of the Related Art Generally, an image forming apparatus, including a printer, a facsimile machine or a multi-function machine includes an automatic document or paper feeder (hereinafter referred to as an automatic paper feeder ), arranged at an upper part thereof, to automatically feed a sheet of document or paper thereinto.

As shown in FIG. 1, a general automatic paper feeder 10 has a paper tray or cassette 11, for stacking or loading sheets of paper therein, having a knock-up plate 13 elastically supported by a elastic spring (not shown) so as to be movable upward and downward. A paper sensor unit 17 senses the sheets of paper, and a pickup unit (not shown) picks up and conveys a sheet of paper from the paper cassette 11.

The paper sensor unit 17 comprises a photo sensor 25, having a light emitting part and a light receiving part, positioned on a fixing bracket 29 of a frame. A sensing actuator 19 protrudes through a paper sensing hole 15 of the knock-up plate 13 so that it is lifted up by the sheets of paper P to operate the photo sensor 25 when the sheets of paper P are placed on the knock-up plate 13, as shown in FIG. 2.

The sensing actuator 19 includes an actuating member 20 protruding through the paper sensing hole 15 of the knock-up plate 13 due to its own weight so as to be lifted up by the sheets of paper P. A sensing trigger 21, movable between the light emitting part and the light receiving part of the photo sensor 25, operates the photo sensor 25. A supporting rod 22 is rotatably supported at the frame and integrally formed with the actuating member 20 and the sensing trigger 21.

The pickup unit is provided with a cylindrical pickup roller (not shown) having a shaft connected with a gear train (not shown) that transmits a driving force of a driving motor (not shown).

The operation of the conventional automatic paper feeder 10 constructed as above is as follows.

After sheets of a document or paper P are placed, or loaded, on the knock-up plate 13, the paper cassette 11 is mounted in the image forming apparatus. As shown in FIG. 2, the sheets of paper P lift up the actuating member 20 of the sensing actuator 19, so that the sensing trigger 21, integrally connected to the actuating member 20 through the supporting rod 22, separates from the photo sensor 25, and moves upward.

As a result, the light receiving part of the photo sensor 25 receives light from the light emitting unit, and sends a "high" signal to a control unit (not shown), and thereby the control unit senses that the sheets of paper P are stacked in the paper cassette 11.

When a command for scanning or printing is input to the image forming apparatus, the control unit supplies electric power to the driving motor to drive the pickup roller, and thereby the pickup roller is rotated.

Accordingly, as the sheets of paper P are separated, one-by-one, by a paper separating unit such as a friction pad (not shown), a sheet of paper P is picked up at the paper cassette 11 by the pickup roller, and conveyed into the image forming apparatus.

In the conventional automatic paper feeder 10, since the photo sensor 25 of the paper sensing part 17 senses only whether the sheets of paper P are loaded in the paper cassette 11, the printing operation may still be carried out when, due to inadequate movement of the pickup roller, one of the sheets of paper P is not picked up, thereby resulting in contamination of the image forming apparatus. Accordingly, in order to sense the pickup error and prevent the contamination of the image forming apparatus, the conventional automatic paper feeder 10 would need to additionally install a separate paper sensor on a paper feeding path in the image forming apparatus.

However, the additional installation of a separate paper sensor, complicates the structure of the image forming apparatus and increases fabrication cost.

SUMMARY OF THE INVENTION

The present invention overcomes the above-mentioned and/or other problems of the related art. Accordingly, it is an aspect of the present invention to provide a pickup error-sensing apparatus of an image forming apparatus and method therefor, simplifying the structure, and reducing fabrication cost, by sensing a pickup error generated as a result of inadequate movement of a pickup roller using a paper sensor installed at a paper cassette without additionally installing a separate paper sensor.

To achieve the above and/or other aspects and other advantages, according to one embodiment of the present invention, a pickup error-sensing apparatus of an image forming apparatus is provided comprising a sensing actuator rotatably disposed at a frame with respect to a paper tray or cassette, displaceable when sheets of paper are loaded in the paper cassette, and a paper sensor unit outputting a paper loading signal and a paper unloading signal according to the displacement of the sensing actuator. A sensing actuator-operating unit operating the sensing actuator allows the paper sensor unit to output the paper unloading signal when the pickup unit carries out a pickup movement. A control unit determines whether the paper unloading signal is output from the paper sensor unit when the pickup unit carries out the pickup movement, and determines an occurrence of a pickup error to stop the operation of the image forming apparatus when the paper unloading signal is not output.

According to an aspect of the present invention, the paper sensor unit includes a photo sensor positioned on the frame and having a light emitting part and a light receiving part. The sensing actuator is composed of an actuating member disposed with respect to the paper cassette to be upwardly and downwardly movable by the sheets of paper loaded in the paper cassette. A sensing trigger is movable between the light emitting part and the light receiving part of the photo sensor allowing the photo sensor to be displaceable between a first position, outputting the paper unloading signal, and a second position, outputting the paper loading signal, according to the movement of the actuating member. A supporting rod is rotatably supported at the frame, and integral with the actuating member and the sensing trigger.

The sensing actuator-operating unit is composed of a knock-up plate disposed in the paper cassette elastically supporting the sheets of paper to be upwardly and downwardly movable, and having a paper sensing opening therein to receive the actuating member so that the actuating member is lifted up by sheets of paper when the sheets of paper are loaded in the paper cassette. The unit also includes a partial, cylindrical part at a part of the pickup unit, When the sheets of paper are loaded in the paper cassette, the partial, cylindrical part is separated from the knock-up plate, and the sheets of paper, to maintain the knock-up plate in an upward position and thereby to displace the sensing trigger into the second position before, and after, the pickup unit carries out the pickup movement. The partial, cylindrical part comes in contact with the knock-up plate and the sheets of paper to maintain the knock-up plate in a downward position, and thereby to displace the sensing trigger into the first position while the pickup unit carries out the pickup movement. The pickup unit can include a pickup roller, or a shaft of the pickup roller.

Alternatively, the sensing actuator-operating unit includes an operating lever at a part of the pickup unit with respect to the sensing actuator, so when the sheets of paper are loaded in the paper cassette, the sensing actuator is displaced into a second position at which the paper sensor unit outputs the paper loading signal before, and after, the pickup unit carries out the pickup movement, and into a first position, at which the paper sensor unit outputs the paper unloading signal while the pickup unit carries out the pickup movement.

The control unit can further include an outside-informing part composed of a speaker sounding an alarm on an occurrence of the pickup error, a display displaying the occurrence of the pickup error in letters or figures, or both the speaker and the display.

According to another embodiment of the present invention, a pickup error-sensing method for an image forming apparatus includes determining whether a paper loading signal is output from a paper sensor unit that is operated by a sensing actuator disposed with respect to a paper cassette, determining whether a pickup driving signal is input when the paper loading signal is output, driving a pickup unit when the pickup driving signal is input, determining whether a paper unloading signal is output from the paper sensor unit when the pickup unit is driven, and determining an occurrence of a pickup error to stop the operation of the image forming apparatus when the paper unloading signal is not output.

According to an aspect of the present invention, the determining whether the paper unloading signal is output includes determining whether the paper unloading signal is output before a predetermined time passes from a point of time when the pickup driving signal is input.

The determining on the pickup error to stop the operation of the image forming apparatus further includes at least one of sounding an alarm on occurrence of the pickup error through a speaker, and displaying an occurrence of the pickup error through a display.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will be apparent and more readily appreciated from the following description of the embodiments taken in conjunction with accompanying drawings in which.

DETAILED DESCRIPTION OF THE INVENTION

Figure 1:
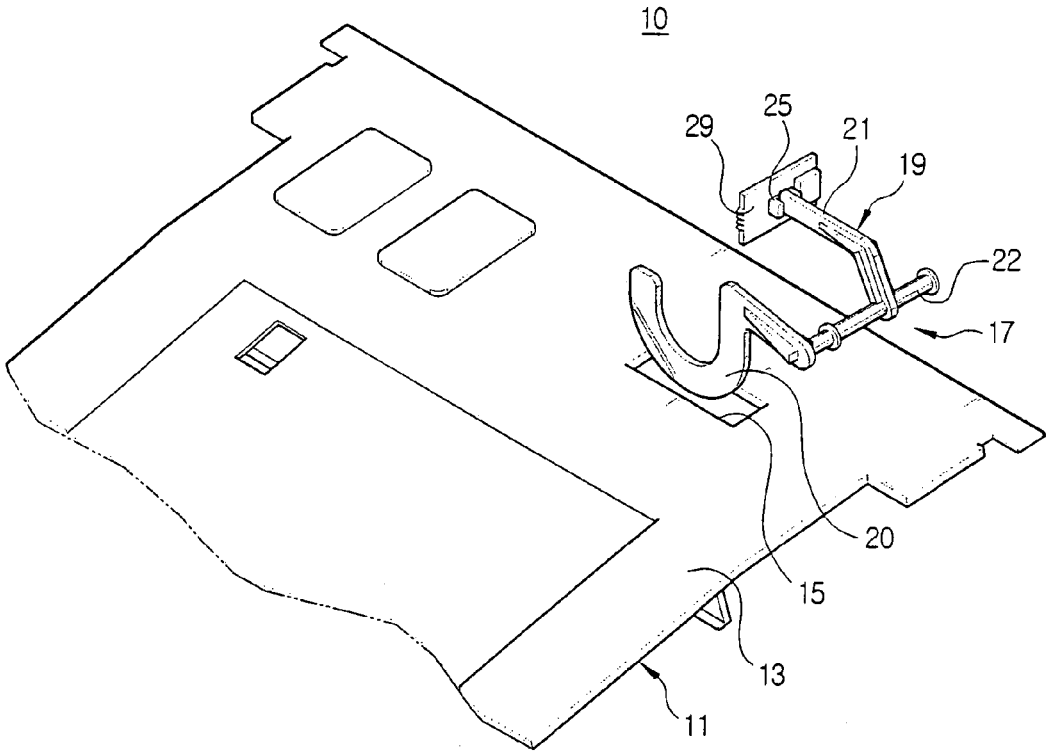
FIG. 1 (PRIOR ART)
FIG. 1 is a partial perspective view of a conventional automatic paper feeder.
Figure 2:
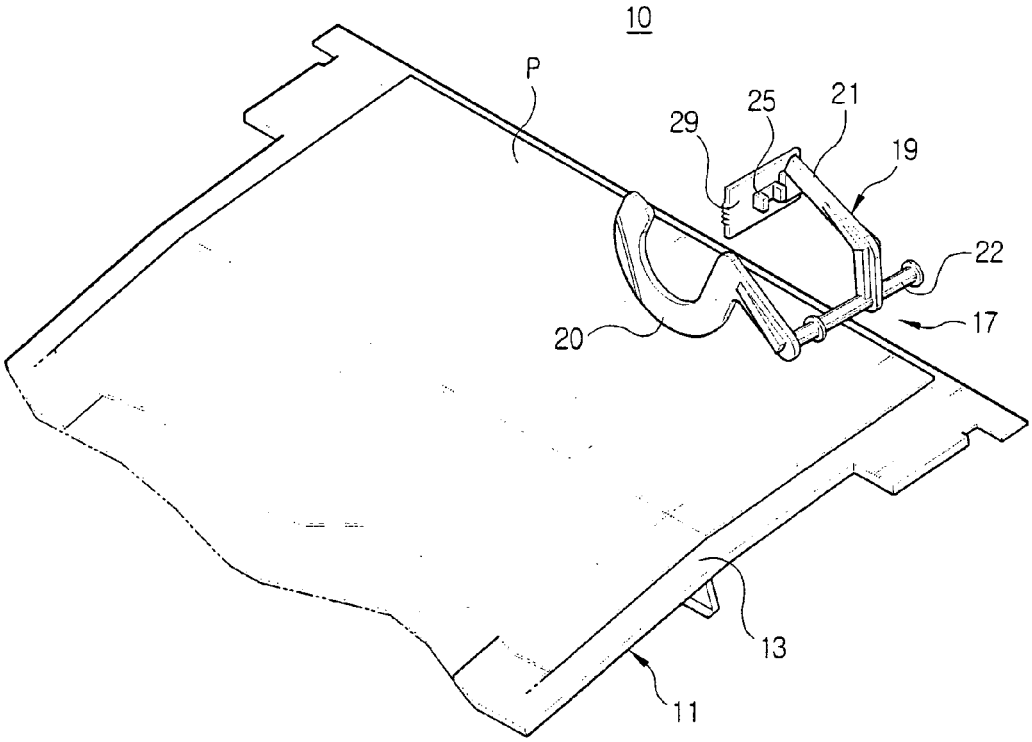
FIG. 2 (PRIOR ART)
FIG. 2 is a partial perspective view of the automatic paper feeder shown in FIG. 1, illustrating the state that sheets of paper are loaded therein.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
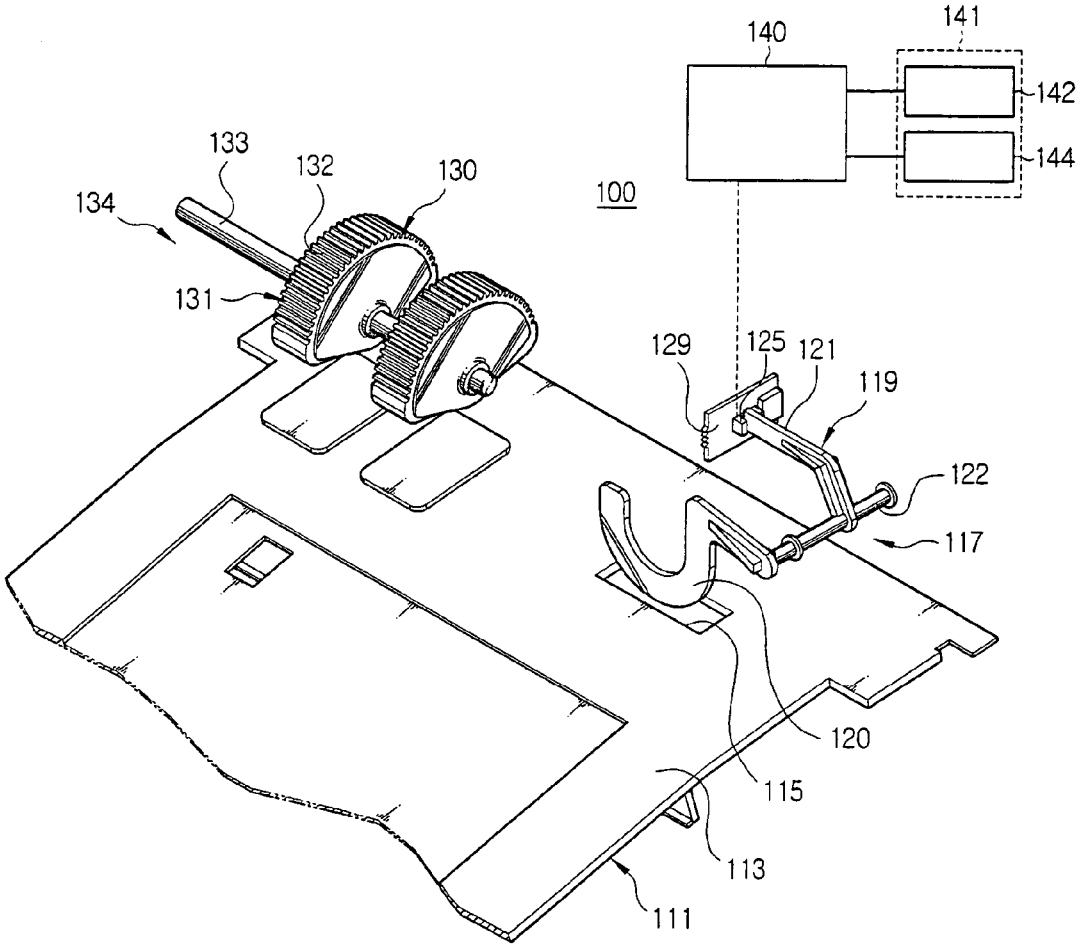
FIG. 3 is a partial perspective view of an automatic paper feeder to which a pickup error-sensing apparatus, in accordance with an aspect of the present invention, is applied.

FIG. 3 schematically shows an automatic paper feeder 100 to which a pickup error sensing apparatus according to an aspect of the present invention is applied.

The automatic paper feeder 100 includes a paper tray, or cassette 111, mounted in a frame (not shown) of the image forming apparatus to stack or load sheets of paper therein, a pickup unit 130 picking up and conveying the sheets of paper loaded in the paper cassette 111, and a pickup error-sensing apparatus 117 sensing a pickup error generated as a result of inadequate movement of a pick-up unit 130.

The paper cassette 111 is provided with a knock-up plate 113 supported by an elastic spring (not shown). Accordingly, the sheets of paper are elastically supported to be upwardly and downwardly movable when loaded in the paper cassette 111.

The pickup unit 130 includes a pickup roller 131 formed in a fan shape and having a shaft 133 connected with a driving motor (not shown) through a gear train (not shown), to transmit a driving force of the driving motor. The knock-up plate 113 and the pickup roller 131 form a sensing actuator-operating unit 134 which will be explained later.

The pickup error-sensing apparatus 117 has a sensing actuator 119 rotatably disposed at the frame with respect to the knock-up plate 113, to be displaceable when the sheets of paper are stacked or loaded in the paper cassette 111, a paper sensor unit 125 outputting a paper loading signal and a paper unloading signal according to the displacement of the sensing actuator 119. The apparatus also includes sensing actuator-operating unit 134 operating the sensing actuator 119 to allow the paper sensor unit 125 to output the paper unloading signal when a sheet of paper is picked up by the pickup roller 131, i.e., when the pickup roller 131 carries out a pickup movement, and a control unit 140 (FIG. 3) determining whether the paper unloading signal is output when the pickup roller 131 carries out the pickup movement, and determining an occurrence of a pickup error to stop the operation of the image forming apparatus when the paper unloading signal is not output.

The paper sensor unit 125 includes a photo sensor disposed at a fixing bracket 129 of the frame and having a light emitting part emitting light and a light receiving part receiving light emitted from the light emitting part.

The photo sensor 125 outputs a high voltage, i.e., a high signal at an ON state when light emitted from the light emitting part is received by the light receiving part, whereas it outputs a low signal at an OFF state when light emitted from the light emitting part is blocked.

The light emitting part and the light receiving part are formed of a light emitting diode and a photo transistor, respectively.

Figure 4A:
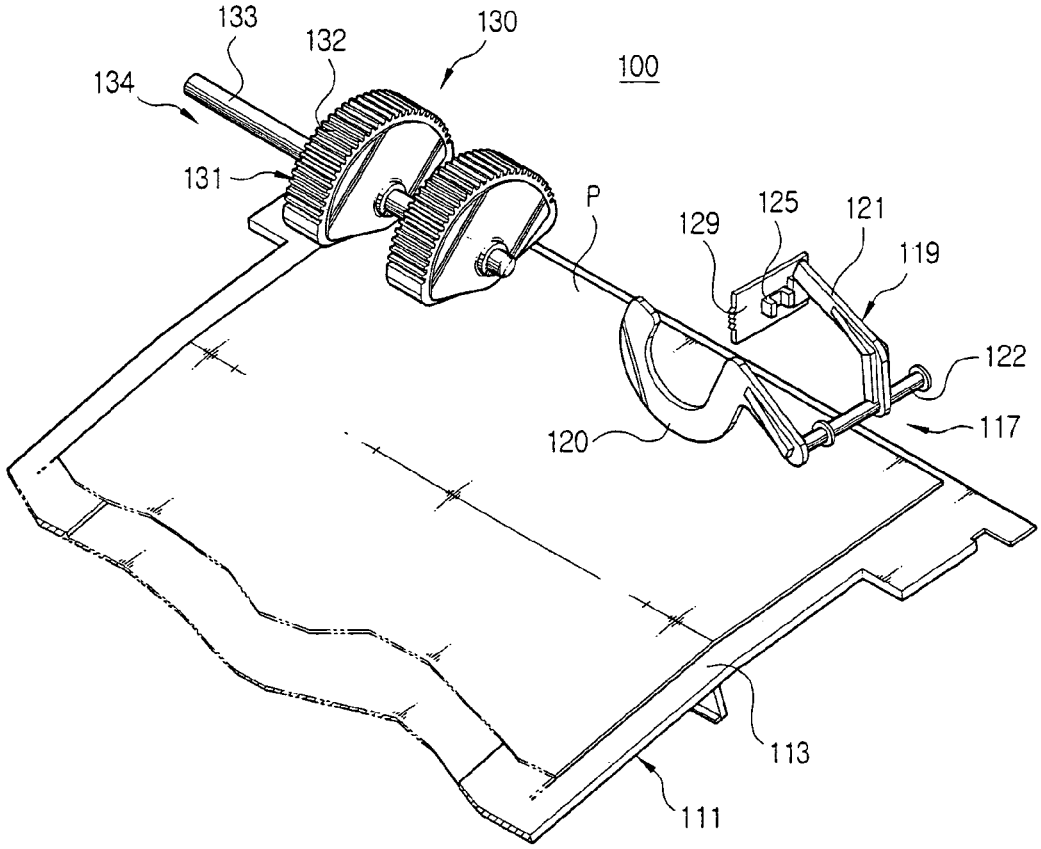
FIGS. 4A and 4B are a partial perspective view and a side elevation view of the automatic paper feeder shown in FIG. 3, illustrating sheets of paper loaded therein.
Figure 4B:
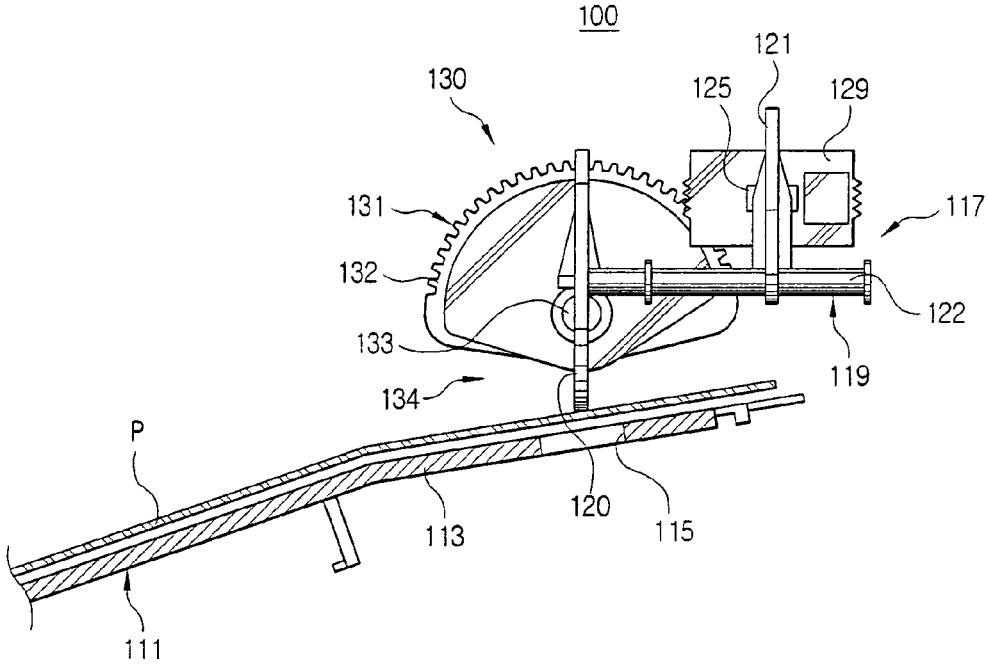

As shown in FIGS. 4A and 4B, the sensing actuator 119 includes an actuating member 129 protruding downward, by its own weight, through a paper sensing groove, or opening 115, of the knock-up plate 113 forming the sensing actuator-operating unit, and lifted upwardly by the sheets of paper P when the sheets of paper P are placed on the knock-up plate 113. The actuator includes a sensing trigger 121 movable between the light emitting part and the light receiving part of the photo sensor 125 to allow the photo sensor 125 to be displaced between a first position (FIGS. 3, 5A and 5B) outputting the low signal, i.e., the paper unloading signal and a second position (FIGS. 4A and 4B) outputting the high signal, i.e., the paper loading signal according to the movement of the actuating member 120. A supporting rod 122 is rotatably supported at the frame and integral with the actuating member 120 and the sensing trigger 121.

The sensing actuator-operating unit 134 is composed of a knock-up plate 113 having the paper sensing opening 115 therein receiving the actuating member 120 so the actuating member 120 is lifted up by the sheets of paper when they are loaded in the paper cassette 111, and a partial, cylindrical part 132 at the pickup roller 131 forming a fan-shaped circumference surface thereof coming in contact with the sheets of paper P, and pressing the knock-up plate 113 when the pickup roller 131 is rotated to carry out the pickup movement.

According to an aspect of the present invention, the partial, cylindrical part 132 is described and illustrated as fan-shaped surface of the pickup roller 131. If the pickup roller 131 is formed in a cylindrical shape, it will include a lever or fan-shaped part having a paper contact surface protruding beyond the circumference surface of the pickup roller 131 from a shaft 133 of the pickup roller 131, or a knock-up plate contact surface formed at the shaft 133 separately with the pickup roller 131, moving the knock-up plate 113 upwardly and downwardly when the pickup roller 131 carries out the pickup movement.

If sheets of paper P are loaded in the paper cassette 111, before and after the pickup roller 131 carries out the pickup movement, the partial, cylindrical part 132 of the pickup roller 131 is positioned to be separated from the knock-up plate 113 and the sheets of paper P maintaining the knock-up plate 113 in an upward position and thereby displacing the sensing trigger 121 of the sensing actuator 119 into the second position (FIGS. 4A and 4B) at which the photo sensor 125 outputs the paper loading signal. When the pickup roller 131 carries out the pickup movement, it is rotated to come in contact with the knock-up plate 113 and the sheets of paper P to move the knock-up plate 113 into a downward position and displace the sensing trigger 121 of the sensing actuator 119 into the first position (FIGS. 3, 5A and 5B) at which the photo sensor 125 outputs the paper unloading signal.

Alternatively, if the paper cassette 111 is a fixed frame or plate (not shown) not including the knock-up plate 113 supported by the elastic spring as in the facsimile machine, the sensing actuator-operating unit can include an operating lever (not shown) positioned at the pickup roller 131 or the shaft 133 thereof projecting toward the actuating member 120 or the sensing trigger 121 of the sensing actuator 119, to operate the sensing actuator 119 when the pickup roller 131 carries out the pickup movement.

As with the partial, cylindrical part 132 of the pickup roller 131, the operating lever operates so that the sensing trigger 121 of the sensing actuator 119 is displaced into the second position as the photo sensor 125 outputs the paper loading signal before, and after, the pickup roller 131 carries out the pickup movement, and into the first position as the photo sensor 125 outputs the paper unloading signal while the pickup roller 131 carries out the pickup movement.

As shown in FIG. 3, the control unit 140 can further include an outside-informing part 141 composed of a speaker 142, sounding an alarm on an occurrence of the pickup error the speaker 142 and the liquid crystal display 144.

The operation of the automatic paper feeder 100 having the pickup error-sensing apparatus 117 according to an aspect of the present invention will be described in detail with reference to FIG. 3 through FIG. 6.

Assuming that sheets of document or paper P are not loaded in the paper cassette 111, as shown in FIG. 3, the actuating member 120 of the sensing actuator-operating unit 119 is inserted into the paper sensing opening 115 of the knock-up plate 113, and the sensing trigger 121, connected to the actuating member 120, is positioned between the light emitting part and the light receiving part of the photo sensor 125 blocking light emitted from the light emitting part.

Figure 6:
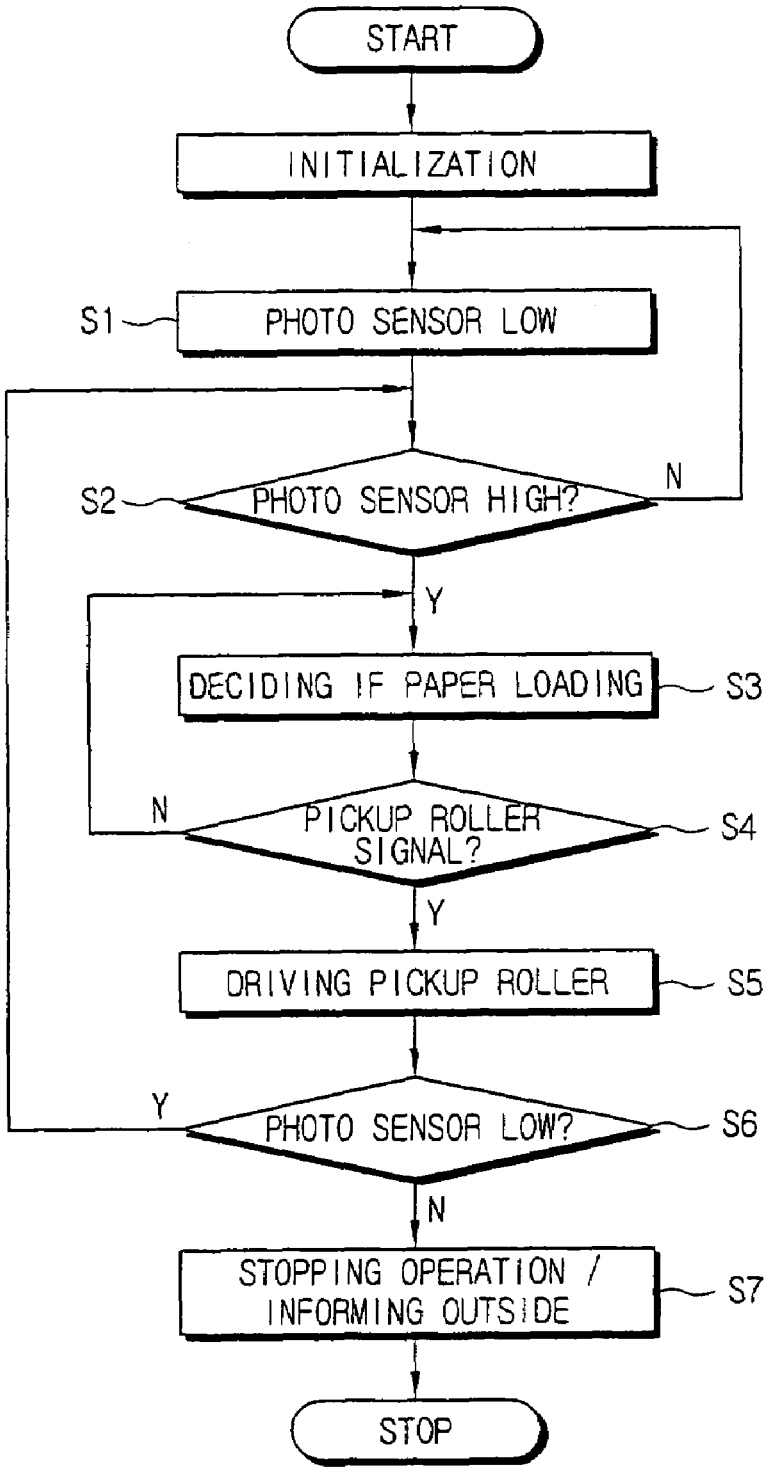
FIG. 6 is a flow chart illustrating an operation of the automatic paper feeder shown in FIG. 3.

When the image forming apparatus is turned on, the photo sensor 125 outputs a low signal, i.e., a paper unloading signal, and thereby the control unit 140 senses that the sheets of paper P are not loaded in the paper cassette 111 (S1, FIG. 6).

As shown in FIG. 3, the partial, cylindrical part 132 of the pickup roller 131 is maintained so as to be separated from the knock-up plate 113 and not in contact therewith, and thereby the knock-up plate 113 is maintained in the upward position.

Thereafter, when sheets of document or paper P are loaded in the paper cassette 111, as shown in FIGS. 4A and 4B, the sheets of paper P lift up the actuating member 120 of the sensing actuator-operating unit 119. At this time, the sensing trigger 121 connected to the actuating member 120 is moved upward.

As a result, the light receiving part of the photo sensor 125 receives light from the light emitting unit thereof, and sends a high signal, i.e., a paper loading signal to the control unit 140 (S2), and thereby the control unit 140 senses that the sheets of paper P are loaded in the paper cassette 111 (S3).

When a command for driving the pickup roller 131, to carry out printing or scanning operation, is inputted from an outer PC (S4), the control unit 140 supplies an electric power to the driving motor to drive the pickup roller 131 (S5).

Figure 5A:
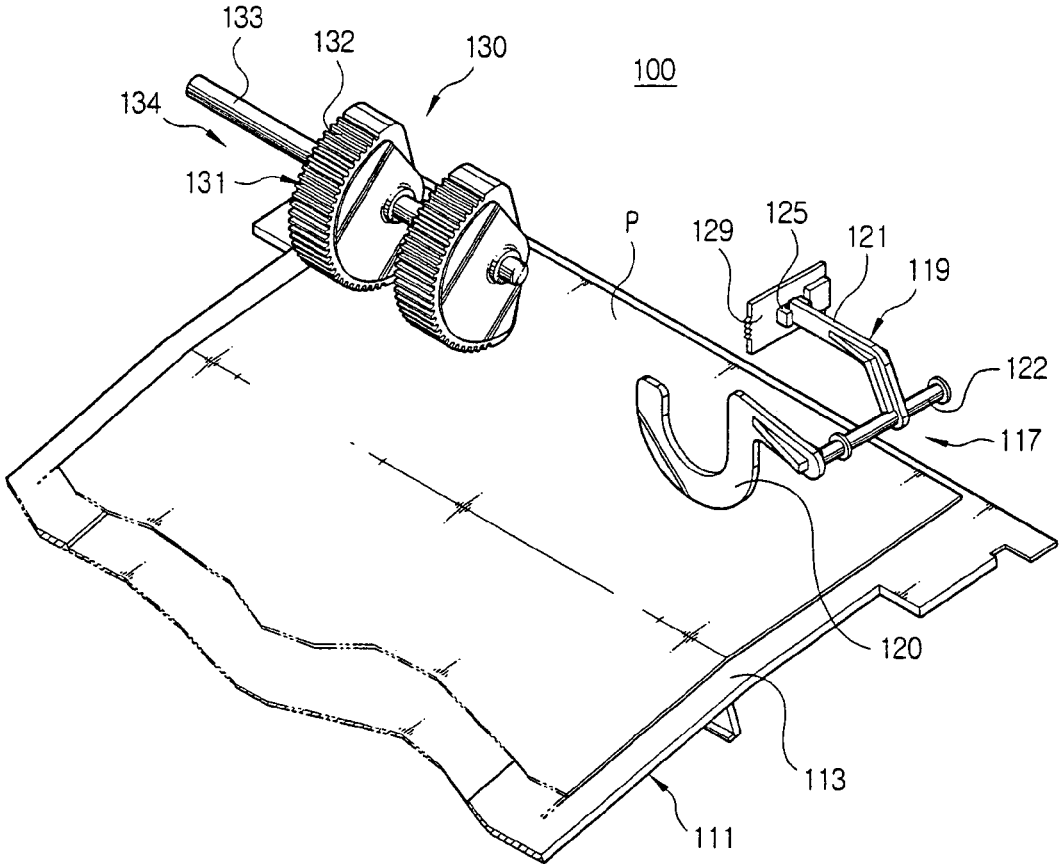
FIGS. 5A and 5B are a partial perspective view and a side elevation view of the automatic paper feeder shown in FIG. 3, illustrating the operation of picking up a sheet of paper.
Figure 5B:
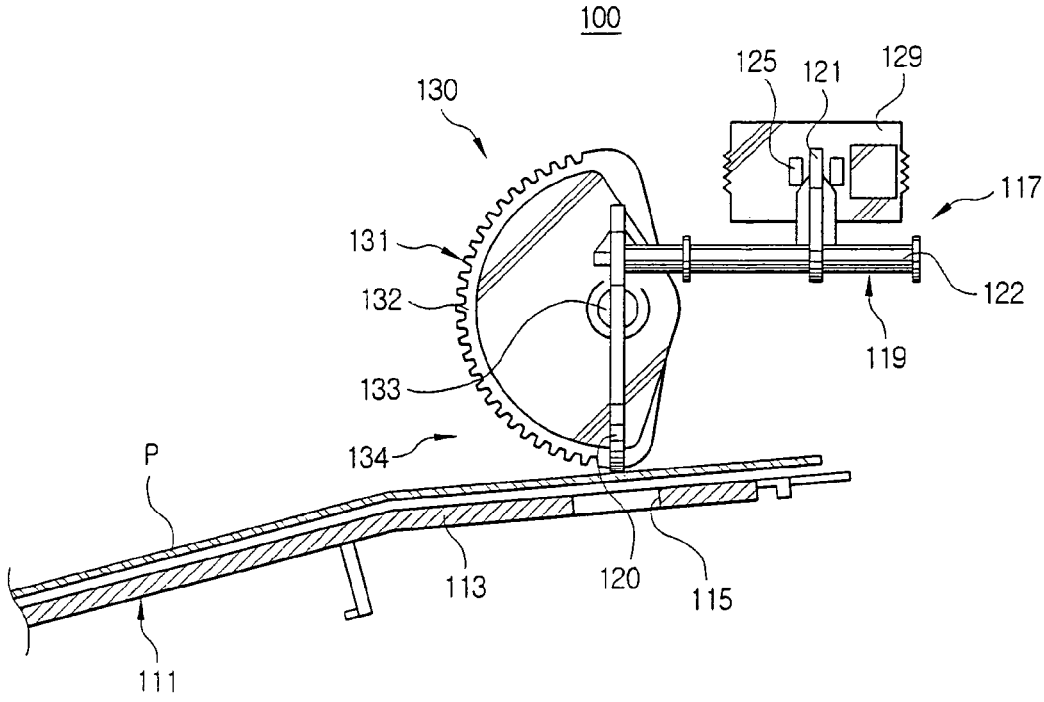

As the pickup roller 131 is rotated, as shown in FIGS. 5A and 5B, the partial circumference part 132 of the pickup roller 131 separates the sheets of paper P one-by-one in cooperation with a paper separating unit such as a friction pad (not shown), and picks up a sheet of paper P at the paper cassette 111 and feeds it into the the image forming apparatus.

At this time, the actuating member 120 of the sensing actuator 119 moves downward by its own weight, together with the sheets of paper P, and the knock-up plate 113, so that the sensing trigger 121 of the sensing actuator 119 is positioned between the light emitting part and the light receiving part of the photo sensor 125 to block light emitted from the light emitting part.

Accordingly, the photo sensor 125 outputs the low signal, i.e., the paper unloading signal (S6), and thereby the control unit 140 determines that the sheet of paper P has been normally picked up, and again repeats the above operations S2 through S5.

However, during operation S5, if due to inadequate movement due to its own defect or error in the gear train for power transmitting, the pickup roller 131 is not rotated, not picking up a sheet of paper P, the photo sensor 125 does not output the paper unloading signal, only the high signal, i.e. the paper loading signal outputting.

Thus, at operation S6, when the paper unloading signal is not output until a predetermined time passes after inputting of the command for driving the pickup roller 131, the control unit 140 determines that the pickup error of the pickup roller 131 occurs, and stops the operation of the image forming apparatus and at the same time sounds an alarm through the speaker 142, or visually displays on the liquid crystal display 144 (S7), or both, that the pickup error occurred.

According to other aspects of the invention, the control unit 140 or other component is a computer implementing the method shown in FIG. 6 using data encoded on a computer-readable medium.

As described so far, it will be appreciated that the pickup error-sensing apparatus of an image forming apparatus and method therefor of an aspect of the present invention can sense the pickup error generated as a result of poor movement of the pick-up roller by only a paper sensor installed at the paper cassette without additionally installing a separate paper sensor, and thereby provides an effect that a structure of the image forming apparatus is simplified and a fabrication cost thereof is reduced.

Although a few embodiments of the invention have been described, it would be appreciated by those skilled in the art that various changes may be made in these embodiments without departing from the principles and spirit of the invention, the scope of which is defined in the claims and their equivalents.

What is claimed is:

1. A pickup error-sensing apparatus for an image forming apparatus, comprising:

a sensing actuator positioned on a paper cassette and movable when sheets of paper are loaded into the paper cassette;

a paper sensor unit outputting a paper loading signal and a paper unloading signal according to the movement of the sensing actuator;

a sensing actuator-operating unit moving the sensing actuator to a first position where the paper sensor outputs the paper unloading signal when a pickup unit carries out a pickup movement, and moving the sensing actuator to a second position where the paper sensor unit outputs the paper loading signal after and before the pickup movement of the pickup unit; and a control unit determining whether the paper unloading signal is output from the paper sensor unit when the pickup unit carries out the pickup movement, and determining an occurrence of a pickup error when the paper loading signal is not output, and interrupting the operation of the image forming apparatus when the occurrence of the pickup error is determined.

2. The apparatus of claim 1, wherein the paper sensor unit comprises a photo sensor having a light emitting part and a light receiving part.

3. The apparatus of claim 2, wherein the sensing actuator comprises:

an actuating member movable by the sheet of paper loaded in the paper cassette, and a sensing trigger movable between the light emitting part and the light receiving part of the photo sensor allowing the photo sensor to be displaced between a first position outputting the paper unloading signal, and a second position outputting the paper loading signal, according to the movement of the actuating member.

4. The apparatus of claim 3, wherein the sensing actuator further comprises a supporting rod rotatably supported at the frame and integral with the actuating member and the sensing trigger.

5. The apparatus of claim 3, wherein the sensing actuator-operating unit, comprises:

a knock-up plate having a paper sensing opening therein to receive the actuating member, wherein the actuating member is moved by the sheets of paper when the sheets of paper are loaded in the paper cassette, and a displacement part of the pickup unit, wherein when the sheets of paper are loaded in the paper cassette, the part is separated from the knock-up plate displacing the sensing trigger into the second position before, and after, the pickup unit carries out the pickup movement, and displacing the sensing trigger into the first position while the pickup unit carries out the pickup movement.

6. The apparatus of claim 3, wherein the sensing actuator-operating unit comprises:

a knock-up plate disposed at the paper cassette elastically supporting the sheets of paper to be upwardly and downwardly movable, and having a paper sensing opening therein to receive the actuating member, wherein the actuating member is lifted up by the sheets of paper when the sheets of paper are loaded in the paper tray or cassette, and a partial, cylindrical part at a part of the pickup unit, wherein when the sheets of paper are loaded in the paper tray or cassette, the partial, cylindrical part is separated from the knock-up plate, and the sheets of paper, maintaining the knock-up plate in an upward position and displacing the sensing trigger into the second position before, and after, the pickup unit carries out the pickup movement, and the partial, cylindrical part comes in contact with the knock-up plate, and the sheets of paper, maintaining the knock-up plate in a downward position displacing the sensing trigger into the first position while the pickup unit carries out the pickup movement.

7. The apparatus of claim 6, wherein the part of the pickup unit comprises one of a pickup roller and a shaft of the pickup roller.

8. The apparatus of claim 1, wherein the sensing actuator-operating unit comprises an operating lever as a part of the pickup unit, wherein when the sheets of paper are loaded in the paper cassette, the sensing actuator is displaced into a second position so the paper sensor unit outputs the paper loading signal before and after the pickup unit carries out the pickup movement, and into a first position so the paper sensor unit outputs the paper unloading signal while the pickup unit carries out the pickup movement.

9. The apparatus of claim 1, wherein the control unit further comprises at least one of an audible alarm and a visual display indicating an occurrence of the pickup error.

10. A pickup error-sensing apparatus for an image forming apparatus, comprising:

a sensing actuator movable when sheets of paper are loaded into the paper cassette;

a paper sensor unit outputting a paper loading signal, and a paper unloading signal when a pickup unit carries out a pickup movement according to the movement of the sensing actuator; and a control unit determining determining an occurrence of a pickup error when the paper loading signal is not output, and interrupting the operation of the image forming apparatus when the occurrence of the pickup error is determined.

11. The apparatus of claim 10, wherein the paper sensor unit comprises a photo sensor having a light emitting part and a light receiving part.

12. The apparatus of claim 11, wherein the sensing actuator comprises:

an actuating member movable by the sheet of paper loaded in the paper cassette, and a sensing trigger movable between the light emitting part and the light receiving part of the photo sensor allowing the photo sensor to be displaced between a first position, outputting the paper unloading signal, and a second position, outputting the paper loading signal, according to the movement of the actuating member.

13. The apparatus of claim 10, wherein the control unit further comprises at least one of an audible alarm and a visual display indicating an occurrence of the pickup error.

* * * * *

UNITED STATES PATENT AND TRADEMARK OFFICE

CERTIFICATE OF CORRECTION

PATENT NO. : 7,063,315 B2
APPLICATION NO. : 10/724723
DATED : June 20, 2006
INVENTOR(S) : Se-hyun Lyu et al.

It is certified that error appears in the above-identified patent and that said Letters Patent is hereby corrected as shown below:

Column 9, Line 14, delete “determining” before “an”.

Signed and Sealed this

Twenty-first Day of November, 2006

JON W. DUDAS
*Director of the United States Patent and Trademark Office*